United States Patent [19]

Drei

[11] Patent Number: 4,764,987

[45] Date of Patent: Aug. 23, 1988

[54] GARMENT PATTERN TRANSFER MARKING DEVICE AND METHOD

[76] Inventor: Clara B. Drei, 287 Cherry St., York, Pa. 17402

[21] Appl. No.: 28,192

[22] Filed: Mar. 19, 1987

[51] Int. Cl.[4] ..... D05B 97/00

[52] U.S. Cl. ..... 2/243 R; 112/104; 112/265.1; 33/13; 101/368

[58] Field of Search ..... 112/262.1, 265.1, 104, 112/113, 115, 131, 121.25; 2/243 B, 243 R; 33/13, 12, 15, 17 R; 101/113, 368

[56] References Cited

U.S. PATENT DOCUMENTS

| | | | |
|---|---|---|---|
| 1,177,740 | 4/1916 | Tully | 101/368 |
| 1,380,418 | 6/1921 | Rosvall | 33/15 |
| 1,385,586 | 7/1921 | Richards | 33/13 |
| 1,560,688 | 11/1925 | Herzberg | 33/13 |
| 1,732,017 | 10/1929 | Jenkins | 101/368 |
| 1,934,282 | 11/1933 | Telzerow | 2/243 B |
| 2,181,600 | 11/1939 | Hoffman | 101/368 |
| 2,569,265 | 9/1951 | Sudhoff | 33/12 |
| 2,636,181 | 4/1953 | Becker | 2/243 B |
| 2,711,588 | 6/1955 | Ingram | 33/12 |
| 2,839,993 | 6/1958 | Orthwin | 101/368 |
| 3,694,921 | 10/1972 | Oblander | 33/17 R |

*Primary Examiner*—H. Hampton Hunter

*Attorney, Agent, or Firm*—Samuel M. Learned, Jr.

[57] ABSTRACT

A garment pattern transfer marking device which provides a capability for first punching out the various pattern reference and feature marks imprinted upon a typical tissue paper garment pattern to thereby enable continued use of the device in effecting die-cut pressure applied deposit of removable adhesive tabs through the punched out pattern reference openings for accomplishing by the method hereof a temporary transfer of garment pattern reference and feature points to the garment material substantially without a danger of causing blemish marking thereof, which adhesive tabs are thereafter easily removed by hand during the course of sequential completion of various sewing, ironing, and tailoring operations in the progress of garment construction without harm or damage to the garment fabric or the leaving of a latent trace or mark therefrom upon the garment fabric.

12 Claims, 4 Drawing Sheets

GARMENT PATTERN TRANSFER MARKING DEVICE AND METHOD

BACKGROUND OF THE INVENTION

The instant invention relates to a device and the method of employment thereof for use by home sewers and dressmakers in accomplishing the markless transfer of a garment layout and features from the typical tissue paper pattern, exemplary of which would be that as generally shown in U.S. Pat. No. 1,560,688 to Herzberg, dated Nov. 10, 1925, to a fabric material from which the garment is to be made, and in particular, for use with the most sheer to heaviest fabric and various of the new synthetic blend fabrics more and more used in the making of high fashion garments so as to avoid the otherwise costly encounter of frequently causing an evident and permanent blemish marking of the material on the finish side thereof which is a problem when traditional and usual methods for pattern transfer marking such as with tracing wheel and carbon, tack stitches, pins, chalk marks, and various "removable" pencil or "disappearing" ink pens are used.

When employing traditional prior art methods of making a pattern transfer to garment fabric by marking with tack stitches or pins there is always the hazard that nicks or burrs on needles and pins will cause permanent damage to fabrics.

The employment of a tracing wheel or tailor's carbon in effecting transposition of pattern to fabric, regardless of how carefully used, will always leave some pigmented residue in the fabric which frequently thereafter results in the causing of an obvious blemish or discoloration evident in the finished garment.

In using the various removable pencil or disappearing ink pens for pattern transfer and feature marking upon material the marking may or may not come out after employing a recommended removal procedure, or may reappear in the fabric as a different permanently set color after using the recommended removal procedure or ironing during garment construction depending upon such factors as the nature of the fabric, penetration of the ink, pressure used when applying the mark, or chemical content of the cleaning medium used in attempting to remove the mark.

When it may be necessary or advantageous to make simultaneous duplicate registered marks on both sides of the material at the same time during pattern transfer operations, the teaching in U.S. Pat. No. 2,839,993 to Orthwin dated June 24, 1958, shows an impact punch device capable of effecting simultaneous duplicate registered carbon marking transfer of a garment pattern layout and pattern reference marks for locating buttons, buttonholes, darts, pleats, pockets and the like at the same time upon both sides of a fabric material from which the garment is to be made. However, even with the Orthwin device employing tailor's carbon, the manufacturer thereof recommends in order to avoid blemishing the material that if it is necessary to transfer pattern marks onto the finish side of the garment fabric that first the pattern marks be transferred with the device to the wrong side of the fabric only, and thereafter transferred to the finish side by use of needle and thread.

By employing an adhesive marking tape strip having a structure generally like that shown in FIG. 6 of U.S. Pat. No. 3,694,921 to Oblander, dated Oct. 3, 1972, in combination with the device of instant invention, applicant herein provides a new and novel apparatus and method for effecting either single or likewise a simultaneous duplicate registered transfer of a garment pattern layout and various other pattern reference marks onto the most sheer to heaviest fabric, even those of the new synthetic blends, but substantially without the danger or costly problem of causing blemish marking thereof, and although some of the elements and functions of the present invention have been disclosed in the art there is no description therein of that combination of elements resulting in the present apparatus structure and method of employment for overcoming the problems of garment material blemishing during pattern transfer marking operations.

SUMMARY OF THE INVENTION

It is the principal object of the present invention to provide a garment pattern transfer marking device and method which enables the user thereof to accomplish a safe, accurate, and efficient transposition of a garment layout from the typical tissue pattern therefor to a wide range of fabric materials, and fabric colors and patterns, substantially without the hazard of blemishing, marring, or damaging the fabric finish.

It is another object of the present invention to provide a garment pattern transfer marking device which is equipped with a detachable pattern punch assembly for use thereof with not only the standard single size garment pattern but also with the type patterns whereon multiple sizes of a particular garment layout are provided on a single tissue paper printed pattern so that the user may first punch out those pattern reference and feature marks pertaining to the particular size thereof desired prior to proceeding with pattern transfer operations so as to substantially reduce the probability of transposition error and facilitate the speed and efficiency of accomplishing pattern transfer to the garment material to be used.

It is also an object of the present invention to provide a garment pattern transfer marking device and method which enables the safe transfer of pattern size reference and feature marks selectively from a pattern to either the finished or wrong side of the garment material singly, or alternatively effect the simultaneous duplicate registered transfer thereof to opposite layered sides of the garment material at the same time during pattern transfer operations.

Still another object of the present invention is to provide a relatively simple and inexpensive garment pattern transfer marking device, and method of employment, which is adapted for use by persons not possessed of any special skills or talent.

The foregoing, and other objects hereof, will be readily evident upon a study of the following specification and accompanying drawings comprising a part thereof.

DETAILED DESCRIPTION OF THE INVENTION

Figure 3:
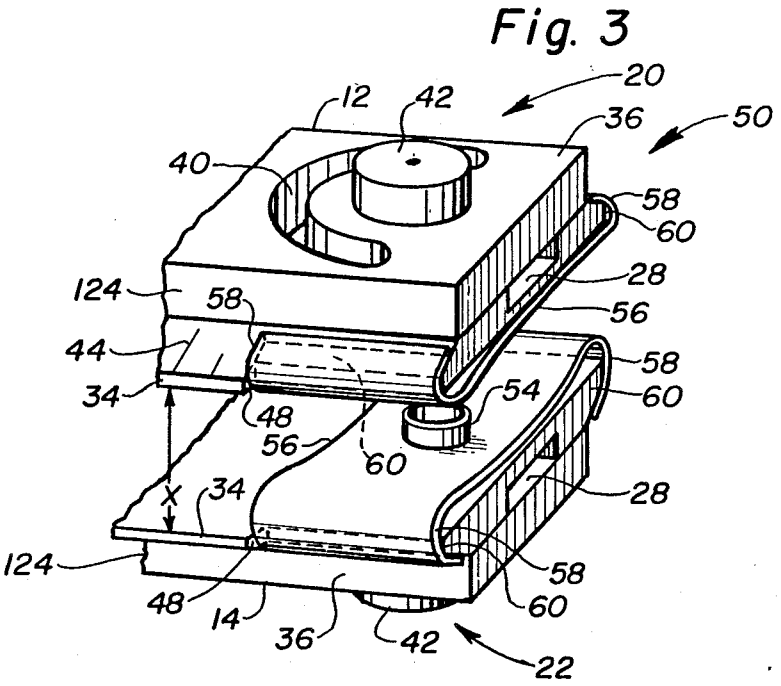
FIG. 3 is a further enlarged perspective view of the detachable pattern punch assembly component of the instant invention showing the punch and anvil elements thereof respectively detachably installed in operational disposition upon the foreshortened upper and lower garment pattern transfer marking member support arms.
Figure 1:
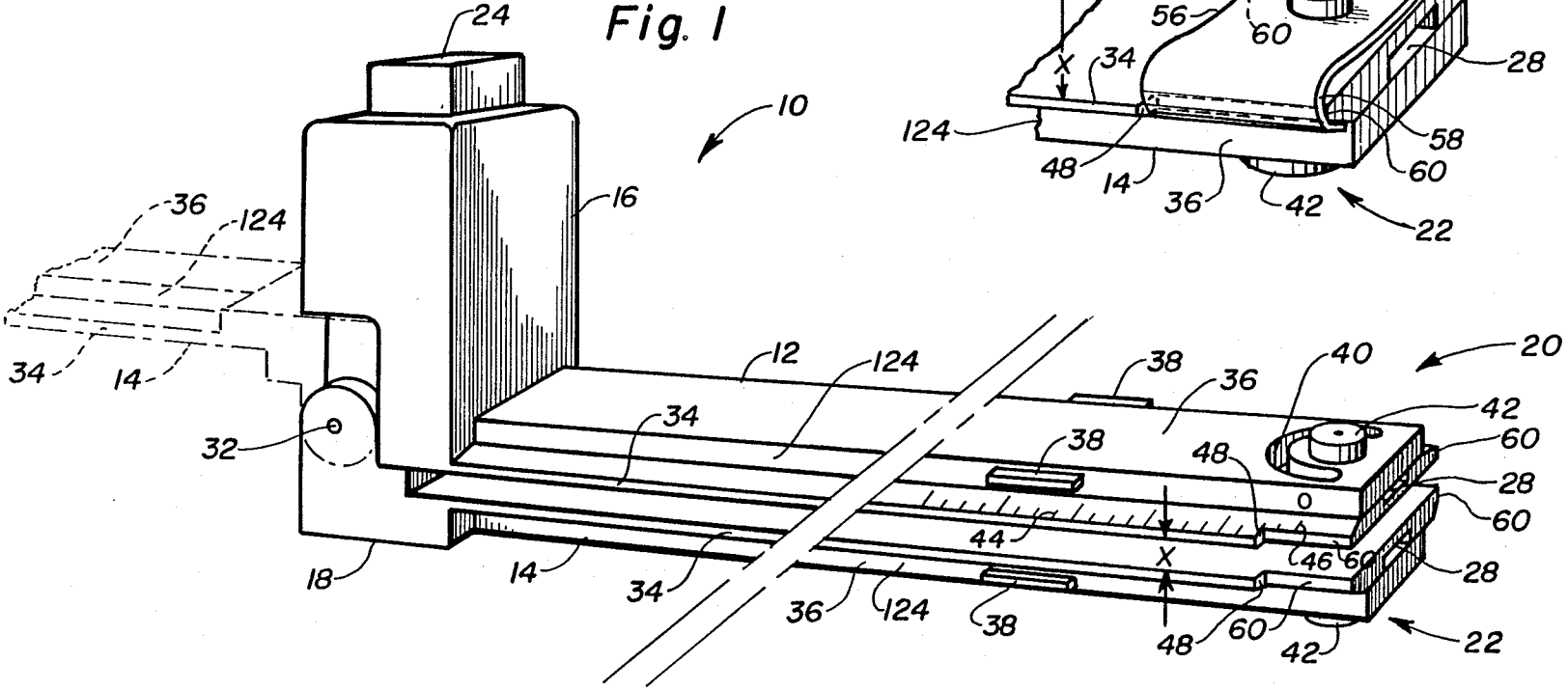
FIG. 1 is a perspective view of the preferred embodiment of the garment pattern transfer marking device comprising the instant invention, with the upper and lower garment pattern transfer marking member support arms thereof respectively foreshortened to accommodate the view to the sheet, further showing therein the lower garment pattern transfer marking member support arm thereof disposed in phantom in the alternate rotationally retracted position.
Figure 2:
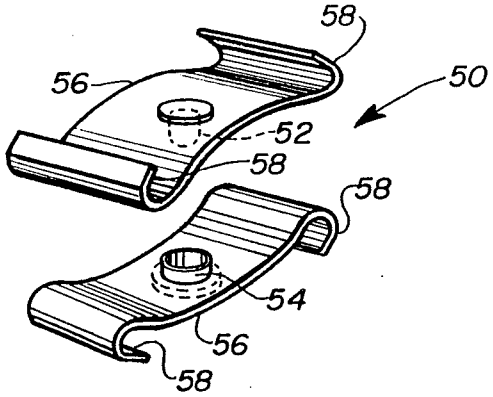
FIG. 2 is an enlarged perspective view of the detachable pattern punch assembly component of the instant invention.

Prior to proceeding into a detailed description of the invention, as will hereinafter more fully be explained with reference to subsequently described FIGS. 1 through 14 illustrated in the accompanying drawings, it should be noted that the garment pattern transfer marking device invention hereof as shown in FIG. 1, and the method of use thereof, is for employment primarily by home sewers and dressmakers in facilitating their transportation of garment pattern reference points in pattern transfer register from the typical tissue paper layout by means of said device, accomplished by accurately and efficiently dispensing and adhereing removable adhesive tabs to either both or layered sides of the garment material simultaneously in accomplishing dual marking, or alternately one side single marking only of the garment material, said adhesive tabs being applied through openings in the tissue paper pattern which correspond to those particular pattern making reference points to be used, said openings having been previously made with a detachable pattern punch assembly as shown in FIGS. 2 and 3, all of which most importantly is accomplished substantially without the danger of causing blemishes or damage to the garment material finish which would be outwardly apparent and highly objectionable in the completed garment appearance thereby diminishing the value and acceptability thereof. It is also to be understood that the marking device invention hereof may be employed without the use of a punched out pattern, as would be the case in marking the so-called unconstructed pattern garments.

Referring now to FIG. 1, the garment pattern transfer marking device 10, with upper and lower parallelly spaced garment pattern transfer marking member support arms respectively 12 and 14 foreshortened to accommodate the view to the sheet, is shown in typical dual or garment material layered marking use configuration with the alternate single marking use configuration thereof being further illustrated wherein the lower garment pattern transfer marking member support arm 14 is disposed in a rotationally retracted position as shown in FIG. 1 in phantom. Further as shown, the marking member support arms 12 and 14 are disposed in a generally spaced parallel relationship one with respect to the other in perpendicularly outward support respectively from the upper and lower garment pattern marking device pusher linkage housing 16 and 18 in the dual marking use configuration to thereby provide an opening denominated "x" therebetween within which a typical tissue paper garment pattern, or fabric material layer from which a garment is to be made, or the assembled combination thereof may be inserted and manually manipulated into position therebetween within the opening for the use of said device 10 by home sewers and dressmakers in quickly, efficiently, and accurately accomplishing the markless transfer of pattern features from the pattern to garment material with removable adhesive tabs by means of the upper and lower support arm adhesive tab punch head assemblies 20 and 22.

Figure 4:
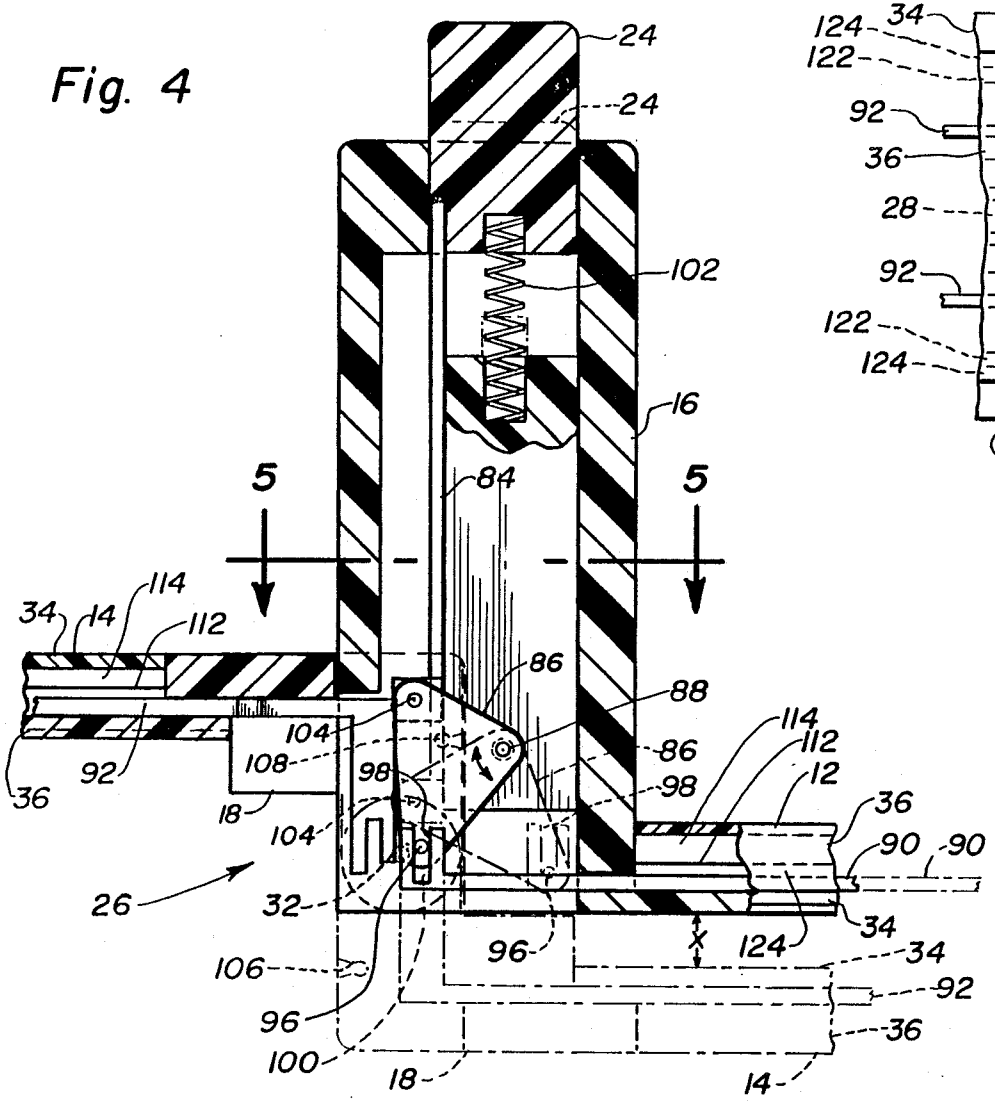
FIG. 4 is an enlarged side elevation cut-away view of the adhesive marking tape strip advance pusher assembly of the garment pattern transfer marking device of instant invention.

Referring again to FIG. 1 to consider in greater detail additional structural features of said device 10 as well as the method of use thereof, wherein it will be noted that protruding from the top of the upper garment pattern marking device pusher linkage housing 16 is a spring loaded thumb button 24 which when manually depressed operates the adhesive marking tape strip advance pusher assembly 26, said assembly 26 not being shown in FIG. 1 but illustrated in FIG. 4 and certain subsequent Figures to be considered in detail hereinafter, whereby marking tape is advanced past the upper and lower adhesive tab punch head assemblies 20 and 22 through marking tape strip guide troughs 28 for die-cut dispensed application through the previously made openings in a tissue paper pattern to the garment material. Downward disposed and pivotally connected at the lower vertical end of the upper pusher linkage housing 16, by means of a set of pivot pintles 32, is the lower pusher linkage housing 18 by which means said lower garment pattern transfer marking member support arm 14 is rotated to the device 10 alternate use position.

With respect to the upper and lower garment pattern transfer marking member support arms 12 and 14 respectively supporting the upper and lower adhesive tab punch head assemblies 20 and 22, both the structure and method of operation thereof are essentially identical and for this reason it is to be understood that the description of one is valid for the other and therefore in the interests of brevity will not per se be repeated. Accordingly, each support arm 12 and 14 is comprised of a base member 34 and a cover member 36 which detachably assembles by means of close clearance friction fit to said base member 34 and is removable therefrom and replaceable thereto by means of cover member handles 38 for purposes of providing access for the loading of strips of adhesive marking tape into said marking tape strip guide troughs 28. Each cover member 36 is also provided with a semi-circular viewing slot 40 whereby facilitated user observation of pattern alignment with the punch head adhesive tab cutting die which is operable by means of manually depressing the spring loaded punch head adhesive tab cutting die button 42. As also shown, the base member 34 is provided with an integral rule 44 with the zero reference 46 thereof indexed to measure set-offs from the center of the punch head adhesive tab cutting die, plus a set of slotted stops 48 which enable the detachable affixment and positioning of the detachable pattern punch assembly 50, as illustrated in FIG. 2, being comprised of the punch element 52 and anvil element 54 each supported by a flexible mounting member 56 in turn provided with an opposingly disposed set of clamp members 58 adapted to slidably fit and frictionally engage the base member slotted stop flanges 60 in detachable affixment of said pattern punch assembly 50 to the outward disposed ends of said support arms 12 and 14 as shown in FIG. 3.

In use application of said device 10, the first step, whether for employment in dual or single marking application as aforedescribed, is to slidably install the detachable pattern punch assembly 50 to the ends of the upper and lower garment pattern transfer marking member support arms 12 and 14 as illustrated in FIG. 3 and thereupon proceed to use said device 10 as so modified as a paper punch in centering and punching out from the tissue paper layout those particular reference marks to be used. It should be remembered that a single tissue paper pattern may contain reference marks for multiple garment sizes of the same design, or possibly certain reference marks for optional garment design features which one may or may not want to use. Experience shows that the pre-punching of pattern feature reference marks to be transposed substantially reduces a likelihood for error or mistake when working with a pattern containing multiple size or optional feature marks, as well as also reducing overall the amount of time to accomplish pattern feature transfer to the garment material with confidence and certainty.

Upon completion of the punching out of the pattern feature marks to be transferred from the tissue paper layout the detachable pattern punch assembly 50 is thereupon slidably removed from the ends of said support arms 12 and 14 of said device 10, and the punched pattern is then assembled to the garment material to be used by any one of several methods well known in the art, as for example, with pins or weights. It should be noted at this point that the diameter of the pattern transfer opening made in the tissue paper layout by means of the detachable pattern punch assembly 50 is slightly larger than that of the die-cut punch of the punch head assembly 20 so that when an adhesive tab is die-cut dispensed thereby for application and adherence to the garment material it will pass through the pattern punched opening without interference or difficulty.

Figure 13:
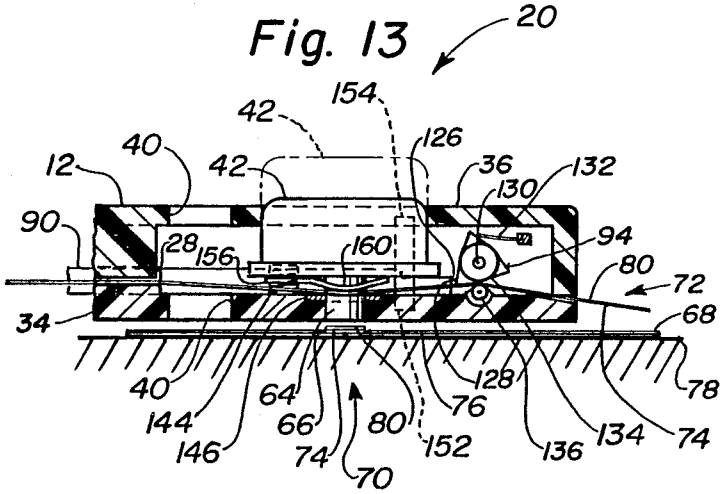
FIG. 13 is a side elevation cut-away view of the upper support arm adhesive tab punch head and tape strip advance assembly operationally showing the punch head in a depressed tape-cut and adhesive tab application configuration and the tape strip advance pusher rod in the neutral retracted configuration.

Whether said device 10 is used in the dual or single marking mode, the method and mechanism, with the exception of rotating the lower garment pattern transfer marking member support arm 14 to the alternate position as shown in phantom in FIG. 1 for use in the single marking mode, is essentially the same. Basically, once the punched pattern is assembled to the garment material, said device 10 is manually manipulated, oriented, and positioned so that, as shown in single marking mode configuration in FIG. 13 to be later hereinafter discussed in greater detail, the adhesive tab punch head assembly 20 is aligned with the die-cut punch 64 thereof centered on the previously punched larger diameter pattern reference mark opening 66 in the tissue paper pattern 68, and then the spring loaded punch head adhesive tab cutting die button 42 is manually depressed to severably effect the die-cut punching of a circular adhesive tab 70 from the marking tape strip 72 for aligned in-register transfer and temporary impressed application thereby of a pattern feature reference mark location from the garment tissue paper pattern 68 by way of adhesive tab strip 74 adhesion of said circular adhesive tab 70 to the garment material 76. It will be noted that when the device 10 is used in a single marking mode configuration as illustrated in FIG. 13, the assembled tissue paper pattern 68 and garment material 76 are placed upon a support surface 78 such as a table top or the like for purposes of effecting punch head assembly 20 circular adhesive tab 70 die-cut punching, in-register transfer, and temporary impressed application thereof as aforedescribed. In the dual use configuration of said device 10, as illustrated in FIG. 1, wherein one accomplishes transfer of a pattern reference feature mark to two layers of folded garment material simultaneously the assembled tissue paper pattern and garment material combination would simply be inserted within the support arm opening "x" and oriented between the upper and lower support arm adhesive tab punch head assemblies 20 and 22, and upon a simultaneous manual depression of the spring loaded punch head adhesive tab cutting die buttons 42 the respective die-cut punches opposingly sever and apply in register adhesively a circular adhesive tab to both layers of said garment material thereby simultaneously transfer marking the particular pattern reference feature to both layers of said garment material.

Figure 14:
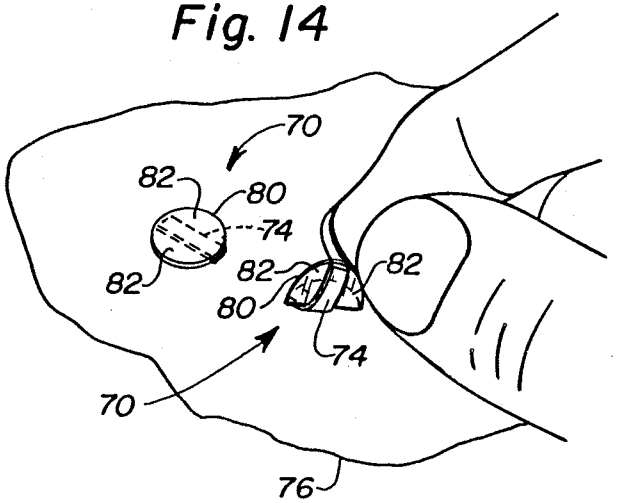
FIG. 14 is an enlarged perspective view illustrating the manual removal of an applied adhesive tab after the use thereof for pattern transfer marking purposes.

Once the adhesive tab 70 has served the garment pattern feature marking purpose for which it was intended, whether for marking a notch, dart, tuck, pleat, pocket, buttonhole location or the like, the tab 70 is then simply manually removed from the garment material 76 preferably by thumb nail and index finger engagement of the adhesive tab backing 80 tape strip backing overlap 82 to break the adhesive strip 74 adhesion to the garment material 76 surface and thereby peelably remove the adhesive tab 70 from the garment material 76 as illustrated in FIG. 14, all substantially without risk of causing marking or blemishing of the garment material 76 finish.

With respect to the foregoing description of method and geometry of the use and structure of said device 10 assemblies and components it should be realized and understood that adhesive tab 70 removal from the garment material 76 may be likewise accomplished by other means such as with tweezers or the like. Also, although the larger diameter pattern reference mark opening 66 made by the detachable pattern punch assembly 50 in the tissue paper pattern 68, and the tape tab 70 have both been shown and described as being circular in shape, it should be further realized and understood that any convenient correspondingly conformed geometrical shape such as rectangular, triangular, hexagonal or such may be likewise employed with equal ease and facility therefor. And finally, although the adhesive tab 70 adhesive means has been shown and described as an adhesive strip 74, it as well could be imposed as a spaced longitudinal series of regularly repeating adhesive dots, or any other suitable geometry employing any of a number of suitable adhering substances.

In summary, then, the specific advantages gained through employing the garment pattern transfer marking device 10 by the method and manner herein described are that it not only enables pattern reference mark transfer without damage to the garment material finish, but pattern reference mark transfer to the garment material is much more quickly and efficiently accomplished since both layers are marked simultaneously, and the method does not require an insertion of the reference mark transfer apparatus between the assembled pattern and material causing pattern and/or material to become misaligned, and therefore transfer of the pattern reference mark locations to the garment material is much more accurately accomplished. Furthermore, marking of unconstructed garments or notches or edge points is extremely quick, easy and accurate without the necessity for pattern pre-punching of transfer marking points simply by positioning said device 10 with the garment material inserted within the support arm opening "x" with the pattern on top of said device 10, align the pattern transfer point to be centered upon the punch head adhesive tab cutting die button 42, and then die-cut and apply an adhesive tab 70 at that position to the opposite side of the garment material.

Turning now to a consideration of FIG. 4 and a more detailed description of the mechanical means whereby said device 10 is operated in the repetitive application of adhesive tabs to garment material in accomplishing pattern reference mark transfer by the method hereof. Shown in FIG. 4 is the marking tape strip advance pusher assembly 26 which through manual initiation by means of the spring loaded thumb button 24 operates to transmit vertical motion through connector rod 84 to a rocker-arm motion translator 86 pivotable about pin 88 and in turn operable to incrementally advance by translated horizontal output motion the marking tape strip 72 by means of upper arm and lower arm tape strip advance pusher rods respectively 90 and 92 in the dual use configuration and the upper arm tape strip advance pusher rod 90 only in the single use configuration whereby the horizontally translated motions thereof effect an advanceable horizontal engagement respectively with a tape strip advance drive wheel cam 94 such as is shown in single use configuration mode in FIG. 7, and upon rotation thereof said tape strip is caused to be moved forward a frictionally driven measured amount thereby in guided control through and within the marking tape strip guide trough 28 for die-cut punching of a fresh adhesive tab therefrom. It will be noted in FIG. 4 as illustrated in part in phantom therein that rocker-arm drive pin 96, cooperatively operating in coactive mechanical communication within the upper and lower arm tape strip advance pusher rod rocker-arm drive pin engagement slots 98 and 100 respectively serves to effect in the dual use configuration the transfer of rocker-arm 86 connector rod 84 transmitted vertical motion to translated upper and lower tape strip advance pusher rod 90 and 92 horizontal drive motion upon manual pressure depression of the spring loaded thumb button 24 to cause compression of the thumb button spring 102 and produce the marking tape strip advance pusher assembly 26 tape strip advance pusher rod extended configuration. When manually applied pressure is released and the spring loaded thumb button 24 is thereafter allowed to return to the thumb button spring 102 extended position as shown in solid line rendition in FIG. 4, then rocker-arm 86 rotating about pin 88 in connection to said spring loaded thumb button 24 through connector rod 84 and connector rod pin 104 returns the marking tape strip advance pusher assembly 26 to the neutral tape strip advance pusher rod retracted configuration. It is, therefore, by the aforedescribed cooperative mechanical means that drive power is imparted through said device 10 to effect delivery of fresh marking tape strip 72 material to and through the adhesive tab punch head assemblies 20 and 22 for repetitive adhesive tab 70 die-cut severing and application thereof.

Additionally shown in FIG. 4 in solid line rendition is the retracted rearward alternate position for lower garment pattern transfer marking member support arm 14, being the single use configuration for said device 10, whereby only the upper garment pattern transfer marking member support arm 12 is employed for pattern feature transfer marking purposes. As previously described, said lower support arm 14 rotates reflexively about the pivot pintles 32 disengaging the tape strip advance pusher rod rocker-arm drive pin engagement slots 100 from the rocker-arm drive pin 96 to the rearward extended retracted position as shown, and is secured in that rearward extended retracted position for single use application of said device 10 by means of retention engagement of the lower support arm spring recess 106 with the upper garment pattern marking device pusher linkage housing retention stud 108.

Figure 5:
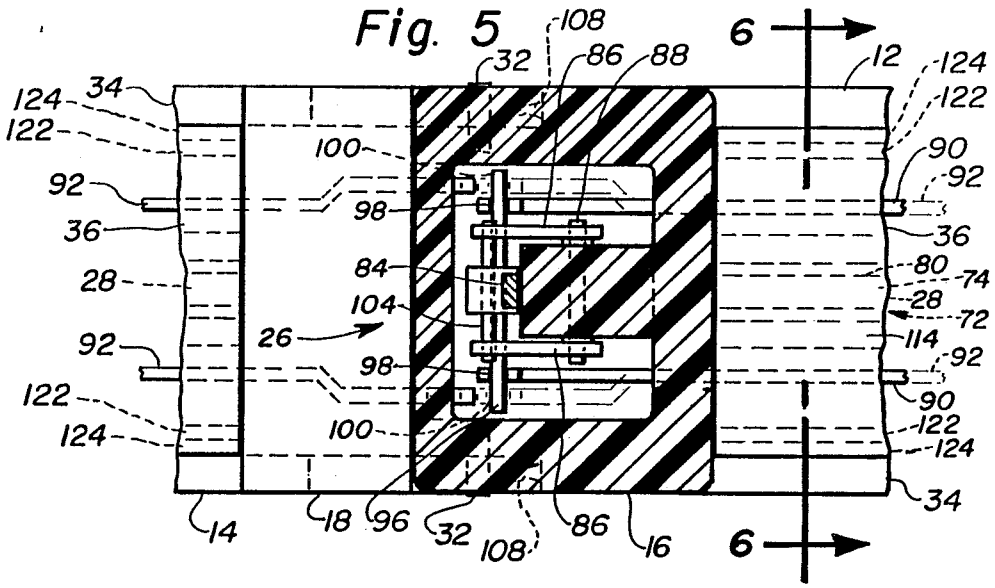
FIG. 5 is a cross sectional top plan view of the adhesive marking tape strip advance pusher assembly shown in FIG. 4 as seen along the line 5—5 thereof.

The illustration shown in FIG. 5 is a top plan view of the marking tape strip advance pusher assembly 26 as seen along the line 5—5 of FIG. 4, and specifically serves to point out that the connector rod 84 operates upon a spaced set of rocker-arm motion translators 86 to in turn operate through the rocker-arm drive pin 96 a cooperatively coactive spaced set of upper and lower arm tape advance pusher rods 90 and 92 whereby balanced non-binding drive force is transmitted to the tape strip advance drive wheel cams 94 to ensure mechanically smooth and uniform advance of the marking tape strip 72 to and through the adhesive tab punch head assemblies 20 and 22 as will hereinafter be discussed and described in greater detail.

The continued detailed description of mechanical features, components, and operation of said device 10 will be in terms of that structure housed within the upper garment pattern transfer marking member support arm 12, which it is to be understood is identical to the mechanical features, components, and operation of that structure of said device 10 housed within the lower garment pattern transfer marking member support arm 14 and will therefore, to avoid duplicity of discussion, not be repeated.

Figure 6:
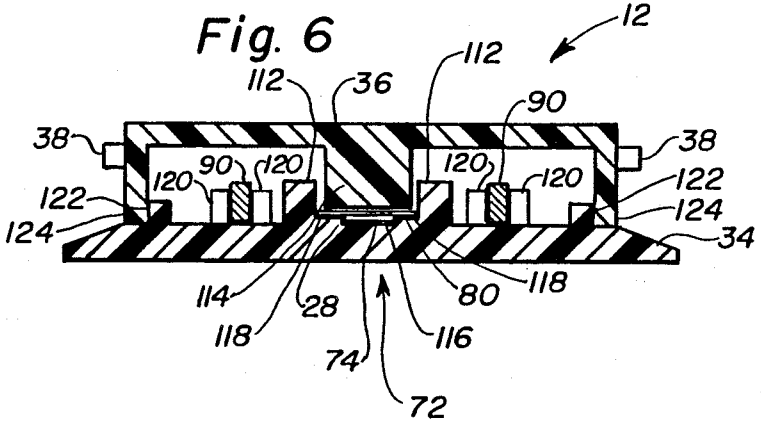
FIG. 6 is an enlarged cross sectional end elevation view of the upper garment pattern transfer marking member support arm shown in FIG. 5 as seen along the line 6—6 thereof.

Detail of the marking tape strip guide trough 28 is better shown in the enlarged cross-sectional end elevation view of the upper garment transfer marking member support arm illustrated in FIG. 6, wherein it can be seen that the marking tape strip 72 is positioned and slidably retained between a spaced set of support arm base member marking tape strip guide walls 112 which receive in non-contact placement therebetween the support arm cover member making tape strip holddown 114 which cooperative combined assembly forms said marking tape strip guide trough. It will also be noted that the base structure between said guide walls 112 is provided with an adhesive tab strip recess 116 and a spaced set of adhesive tab backing support ledges 118 so as to suspend the adhesive tab strip 74 and prevent contact thereof with the base structure during use and thereby in turn avoid marking tape strip 72 advance problems due to adhesive tab strip 74 contact and adhesion within the guide trough 28 structure during device 10 use.

Additional marking member support arm structural features best shown in FIG. 6 include the tape advance pusher rod guide lugs 120 which are laterally spaced projections longitudinally disposed along the interior of the support arm base member 34 that serve to provide close lateral support for the tape strip advance pusher rods 90 during reciprocal movement thereof upon activation and de-activation of the spring loaded thumb button 24 operating to translate motion transfer through the marking tape strip advance pusher assembly 26 in accomplishing marking tape strip 72 advancement as aforedescribed. Also shown in FIG. 6 are the base member latch rails 122 against which the cover member 36 normally projecting enclosement sides 124 compressively conform for effecting detachable assembly affixment thereto as also previously described.

Figure 7:
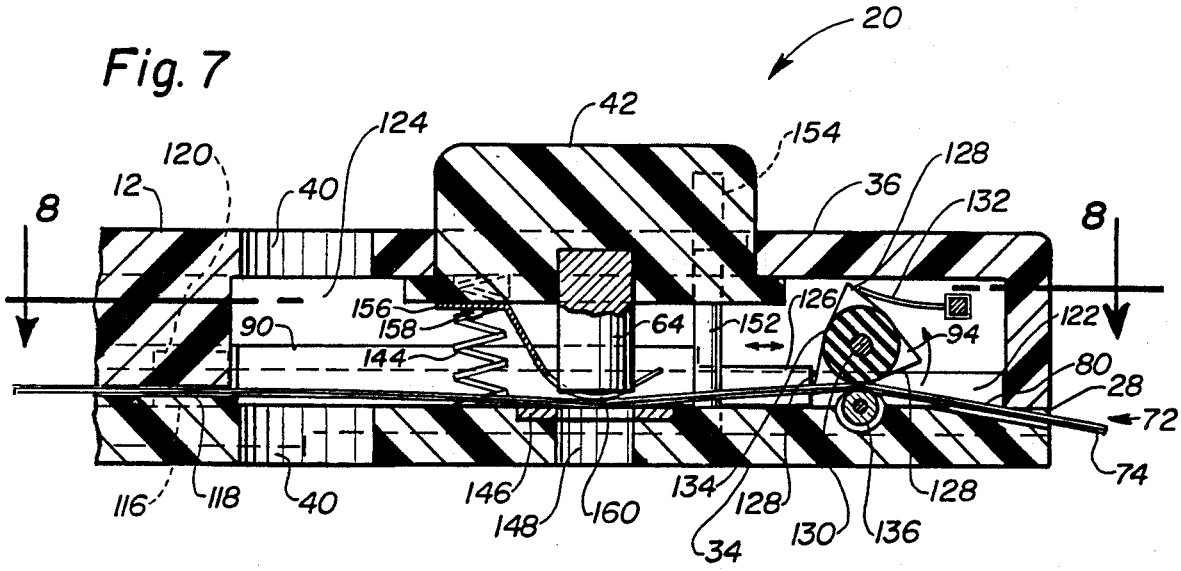
FIG. 7 is an enlarged side elevation cut-away view of the upper support arm adhesive tab punch head and tape strip advance assembly of the garment pattern transfer marking device of instant invention.
Figure 8:
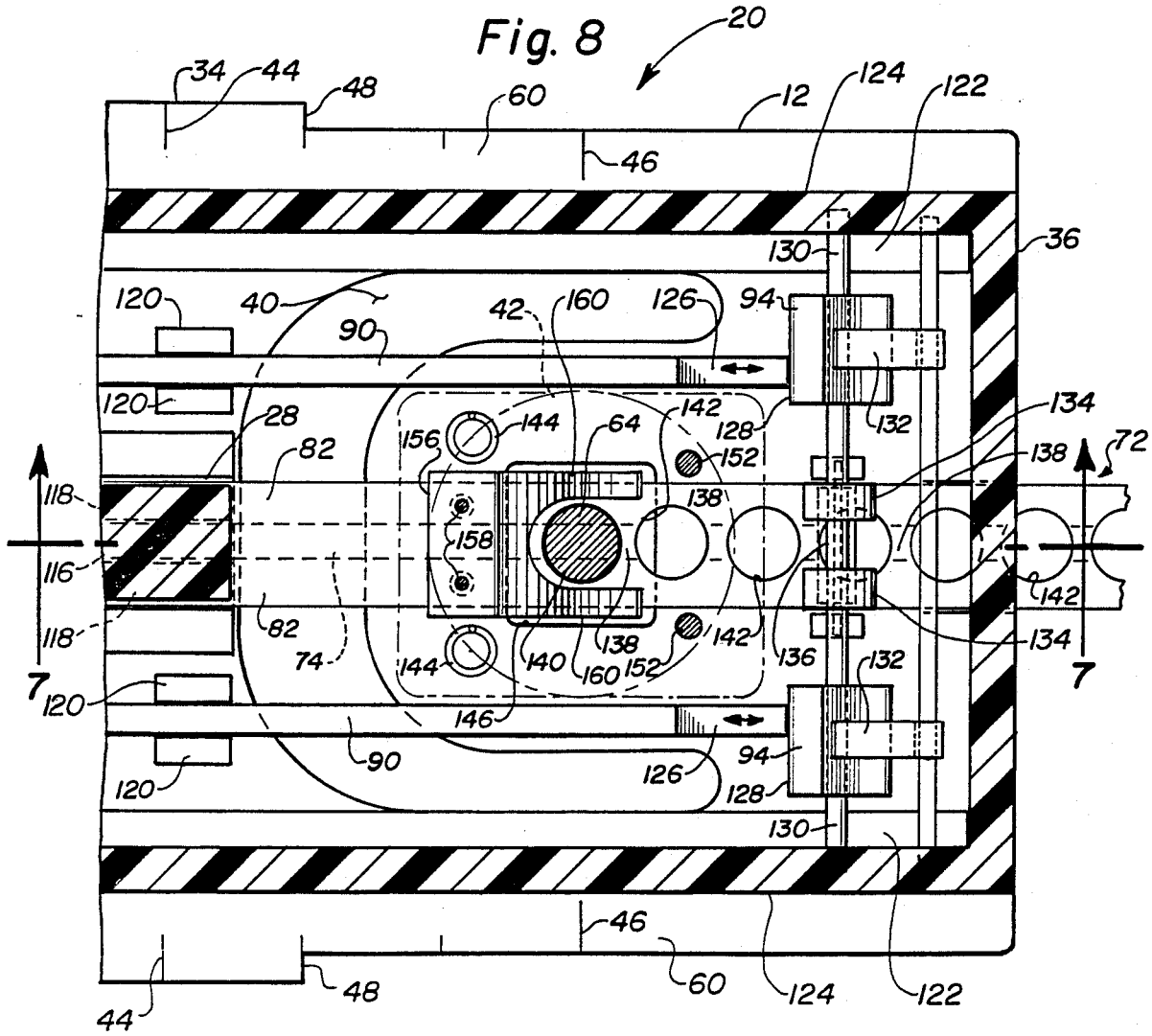
FIG. 8 is a cross sectional top plan view of the upper support arm adhesive tab punch head and tape strip advance assembly shown in FIG. 7 as seen along the line 8—8 thereof.

Turning now to a consideration of FIGS. 7 and 8 which respectively show an enlarged side elevation cut-away view and a cross sectional top plan view of the support arm adhesive tab punch head assembly 20, and particularly the relative structural assembly relationships of both the marking tape strip advance and adhesive tab cutting components. With respect to the marking tape strip 72 advance, it will be noted that the tape strip advance pusher rods 90 cooperatively aligned through the pusher rod guide lugs 120 are positioned so that the pusher rod drive wheel cam engagement projections 126 respectively thereof touch at rest, in the device 10 neutral tape strip advance pusher rod retracted configuration as shown, one of the tape strip advance drive wheel cam 94 cam engagement surfaces 128. The set of drive wheel cams 94 are fixedly assembled to a rotating shaft 130 which turns against the restraining leaf spring force of a spaced set of cam retaining dogs 132 when the tape strip advance pusher rods 90 advancedly engage against a cam engagement surface 128 upon a manual depression of the spring loaded thumb button 24 as earlier described, and that manual depressive force upon said thumb button 24 in vertically to horizontally translated drive force operating through the rocker-arm motion translator 86 overcomes the combined cam retaining dog 132 restraining leaf spring forces, whereupon the pusher rods 90 drive wheel cam engagement projections 126 push against the cam engagement surfaces 128 causing them to coactively move arcuately forward and impart a balanced rotary advance motion to shaft 130 to which is also fixedly assembled a spaced set of contact rollers 134 that engage the tape strip backing overlap 82 of the marking tape strip 72 compressively against the marking tape advance backup roller 136 and thereby effect a frictionally driven marking tape advance by a measured amount which is equivalent to the horizontally translated displacement of the cam engagement surface 128 rotary displacement and just sufficient to provide fresh marking tape 72 for adhesive tab punching purposes with a slight interconnecting marginal web segment 138 remaining between the tab to be punched 140 and the previously punched adhesive tab hole 142.

Considering now FIGS. 7 and 8 concurrently with respect to the adhesive tab cutting components of the adhesive tab punch head assembly 20. When the marking tape strip 72 is advanced as just previously described then one is ready to employ the adhesive tab punch head assembly 20 for cutting and application of a die-cut adhesive tab in accomplishing transfer marking of a pattern feature to the garment material. It will be noted that the punch head adhesive tab cutting die button 42 of said assembly 20 operates against the compressive force of button return springs 144 and maintains the die-cut punch 64 supported thereby in vertical alignment with the adhesive tab die-cut punch plate 146 and the adhesive tab application opening 148 by means of the punch guide pin 152 which guides within the punch head guide pin recess 154. Further, to insure mechanical alignment of not only the adhesive tab punch head assembly 20 components by the means as above described, but also to insure alignment and retention of the adhesive tab strip 72 when positioned for adhesive tab punching, the punch head assembly is provided with a spring retainer 156 secured to the rear underside surface of the punch head adhesive tab cutting die button 42 by means of screws 158, which spring retainer 156 comprised a spaced set of spring retention fingers 160 that compressively engage respectively the tape strip backing overlaps 82 upon manual depression of the punch head adhesive tab cutting die button 42 and thereby stabilize and hold the marking tape strip 72 in position against the adhesive tab die-cut punch plate 146 during tape tab die-cut severing and transfer application of an adhesive tab 70 through the adhesive tab application opening 148 to the garment material.

Figure 11:
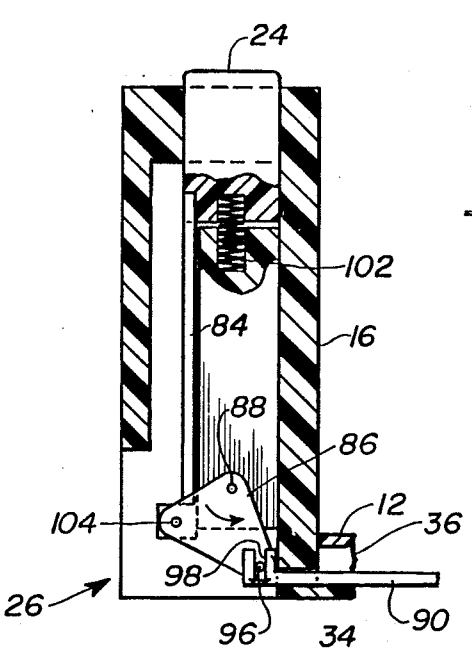
FIG. 11 is a simplified side elevation cut-away view of the adhesive marking tape strip advance pusher assembly and upper support arm adhesive marking tape strip advance pusher assembly linkage communicating therewith being respectively shown in the operational tape advance pusher rod extended configuration.
Figure 12:
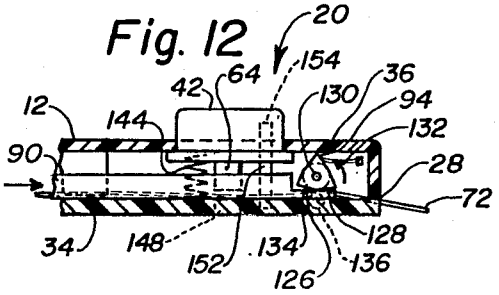
FIG. 12 is a simplified side elevation cut-away view of the upper support arm adhesive tab punch head and tape strip advance assembly therein shown with the tape strip advance pusher rod in the operational extended configuration which corresponds to the pusher assembly disposition shown in FIG. 11.
Figure 9:
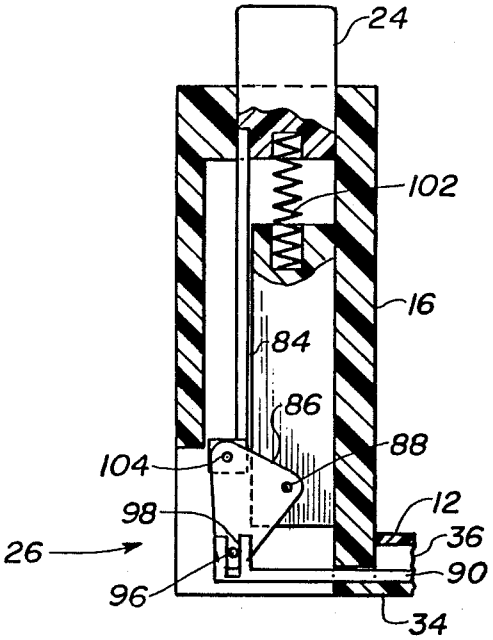
FIG. 9 is a simplified side elevation cut-away view of the adhesive marking tape strip advance pusher assembly and upper support arm adhesive marking tape strip advance pusher assembly linkage communicating therewith being respectively shown in the neutral tape advance pusher rod retracted configuration.
Figure 10:
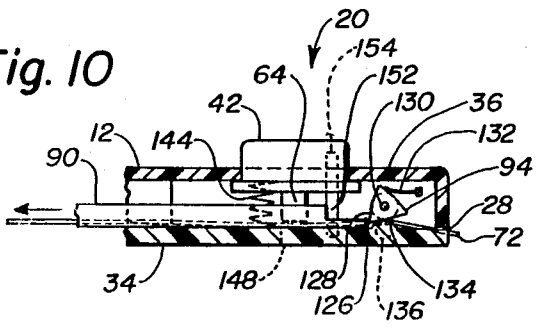
FIG. 10 is a simplified side elevation cut-away view of the upper support arm adhesive tab punch head and tape strip advance assembly therein shown with the tape strip advance pusher rod in the neutral retracted configuration which corresponds to the pusher assembly disposition shown in FIG. 9.

The illustrations of FIGS. 9 and 10 respectively show the device 10 tape strip advance pusher assembly and motion translator linkage communicating therewith on the one hand, in cooperative forshortened views mechanically intercommunicating through the tape strip advance pusher rod 90 to the tape strip advance drive wheel cam and friction drive assembly on the other hand, when said device 10 tape strip advance mechanisms as previously described in detail are disposed in the neutral retracted configuration, that is, the spring loaded thumb button 24 is held in an up position under the extensive resilient force of thumb button spring 102. In mechanically comparative contrast to the FIGS. 9 and 10 illustrations, the FIGS. 11 and 12 illustrations respectively likewise show the device 10 tape strip advance pusher assembly and motion translator linkage communicating therewith on the one hand, in cooperative forshortened views mechanically intercommunicating through the tape strip advance pusher rod 90 to tape strip advance drive wheel cam and friction drive assembly on the other hand, but when said device 10 tape strip advance mechanisms as also previously described are disposed in the operational tape strip advance pusher rod extended configuration, that is, the spring loaded thumb button 24 is manually held in a down position against the compressive resilient force of thumb button spring 102 and the tape strip advance pusher rod 90 has thereby been moved forward by virtue of vertical to horizontal translated motion through the motion translator linkage communicating therewith so that the pusher rod drive wheel cam engagement projection advancing against a cam engagement surface 128 of the tape strip advance drive wheel cam 94 overcomes the resilient resistance force exerted by the cam retaining dogs 132 and causes said drive wheel cam 94 to rotate thereby driving the spaced set of contact rollers 134 intercommunicating therewith upon shaft 130 in rotation against the marking tape strip advance backup roller 136 with the tape strip backing overlaps 82 compressively engaged therebetween and thereby frictionally advancing the marking tape strip 72 a measured amount as shown in FIG. 12 so that a fresh adhesive tab may be punched therefrom.

The enlarged side elevation cut-away view in FIG. 13 shows operation of the adhesive tab punch head assembly in the die-cut severing and application of an adhesive tab 70 through a previously punched larger diameter pattern reference mark opening 66 of a typical tissue paper pattern 68 in effecting a pattern reference mark transfer to a garment material 76. It will be noted that the tape strip advance pusher rod 90 is re-disposed in a neutral retracted configuration and that as the spring loaded punch head adhesive tab cutting die button 42 has been manually depressed to effect a die-cut severing of an adhesive tab 70 from the marking tape strip 72, wherein the spring retention fingers 160 of the spring retainer 156 have compressively engaged the tape strip backing overlaps 82 against the adhesive tab die-cut punch plate 146 so that said marking tape strip 72 is positioned and securely retained in place during completion of the adhesive tab die-cut operation.

Lastly, as previously described in detail during the method discussion, the view shown in FIG. 14 illustrates that technique preferred for removal of an adhesive tab 74 from a garment material 76 after the adhesive tab has served the pattern transfer marking function for which it was applied.

Preferably, the garment pattern transfer marking device 10 of instant invention is made by appropriate manufacturing methods from a combination of suitable plastic and metal materials, however, any materials or combinations thereof which would be suitable may be employed.

Although the garment pattern transfer marking device invention hereof, the structural and mechanical assemblies thereof, and the method of employment thereof, respectively have been shown and described in what are conceived to be the most practical and preferred embodiments, it is recognized that departures may be made respectively therefrom within the scope of the invention, which is not to be limited per se to those specific details as disclosed herein but is to be accorded the full scope of the claims so as to embrace any and all equivalent devices, apparatus, and methods.

I claim:

1. A method of garment pattern transfer marking accomplished substantially without residual garment material blemish consequences, employed for effecting a temporary transfer of garment pattern reference and feature points from a typical garment pattern to a garment material and comprising the steps of preparing a punched out garment pattern by first punching out each garment pattern reference and feature point to provide an opening therefor in said garment pattern for each of said garment pattern reference and feature points to be transposed from said garment pattern to said garment material, assembling said punched out garment pattern to said garment material by use of pins or other suitable means, orienting and aligning a garment pattern transfer marking device embodying an adhesive tab die-cut punch means sequentially with each of said openings and thereupon die-cut punch applying therewith from a marking tape strip an adhesive tab of a lesser peripheral geometrically conformed dimension than that of said opening therethrough to said garment material in respectively accomplishing a temporary garment pattern transfer marking thereby upon said garment material, removing said punched out garment pattern from said garment material upon completion of sequential adhesive tab transfer of each garment pattern reference and feature point thereto, and thereafter sequentially accomplishing garment fabrication and tailoring operations with a corresponding sequential removal of said adhesive tabs from said garment material upon respective sequential completion thereof.

2. The method of garment pattern transfer marking according to claim 1 wherein said garment pattern transfer marking device is adapted to compressively apply said adhesive tabs in the temporary marking of a particular garment pattern reference or feature point in opposingly aligned relationship to both sides of said garment material simultaneously.

3. The method of garment pattern transfer marking according to claim 1 wherein said garment pattern transfer marking device is adapted to apply an individual adhesive tab in the temporary transfer marking of a particular garment pattern reference or feature point to one side of said garment material only.

4. A garment pattern transfer marking device for accomplishing temporary transfer of garment pattern reference and feature points from a typical garment pattern to a garment material, comprising a pivotally connected set of parallelly spaced support arm means for holding in opposingly spaced aligned facing relationship a cooperative set of adhesive tab punch head assemblies, a detachable set of punch and anvil means removably connectable cooperatively to said adhesive tab punch head assemblies for punching out the garment pattern reference and feature points from said garment pattern, a marking tape strip respectively supported within each of said pivotally connected set of parallelly spaced support arm means, a marking tape strip advance means for incrementally moving said marking tape strips a repeatably measured amount respectively within each of said pivotally connected set of parallelly spaced support arm means advancedly to each of said adhesive tab punch head assemblies respectively supported thereby, and a set of die-cut punch means supported within each of said adhesive tab punch head assemblies adapted to cooperatively die-cut sever respectively from each of said marking tape strips an adhesive tab of lesser geometrically conformed dimension than that of a punched out garment pattern reference or feature point opening previously made in said garment pattern with said detachable set of punch and anvil means and compressively apply in opposingly aligned relationship through said punched out opening sequentially said adhesive tab to opposite layered sides of said garment material when said garment pattern and said garment material are temporarily assembled one to the other for purposes of accomplishing garment pattern reference and feature point transfer.

5. The garment pattern transfer marking device according to claim 4 wherein said set of parallelly spaced support arm means are respectively provided with a support arm cover member detachably assembled to a support arm base member being adapted to accommodate facilitated loading of said marking tape strips therein.

6. The garment pattern transfer marking device according to claim 5 wherein said support arm cover member is provided with a viewing slot at the adhesive tab punch head assembly support end thereof being adapted to accommodate garment pattern punched out opening alignment of said die-cut punch means therewith.

7. The garment pattern transfer marking device according to claim 5 wherein said support arm base member is provided with a marking tape strip guide trough being adapted to receive and advanceably support said marking tape strip therewithin.

8. The garment pattern transfer marking device according to claim 4 wherein said detachable set of punch and anvil means are respectively removably connectable cooperatively to said adhesive tab punch head assemblies by means of a clamp member.

9. The garment pattern transfer marking device according to claim 4 wherein said marking tape strip is provided with an adhesive tab strip assembled to a tape tab backing whereby a tape strip backing overlap is provided on either lateral side of said adhesive tab strip over the longitudinal dimension thereof.

10. The garment pattern transfer marking device according to claim 4 wherein said marking tape strip advance means is comprised of a connector rod reciprocally operable by means of a spring loaded thumb button to transmit manually initiated vertical motion through a rocker-arm motion translator in pivotally connected communication therewith to thereby translate said vertically initiated motion to horizontal motion through a tape strip advance pusher rod likewise in pivotally connected communication with said rocker-arm motion translator.

11. The garment pattern transfer marking device according to claim 10 wherein said tape strip advance pusher rod operates in horizontal motion translation against an engagement surface of a tape strip advance drive wheel cam communicating by a rotating shaft with a spaced set of contact rollers which compressively engage rotationally a tape strip advance backup roller whereby said marking tape strip backing overlaps are compressively engaged therebetween and said marking tape strip is thereby incrementally advanced to position a fresh marking tape strip segment at the die-cut severing location within said adhesive tab punch head assembly.

12. The garment pattern transfer marking device according to claim 11 wherein said adhesive tab punch head assembly is provided with a set of spring retention fingers adapted to resiliently deform in compressive engagement of said marking tape strip backing overlaps to stabilize and retain said fresh marking tape strip segment at the die-cut punch location during adhesive tab severing and application operation of the adhesive tab punch head assembly.

* * * * *